US006648527B2

(12) United States Patent
Takahashi et al.

(10) Patent No.: US 6,648,527 B2
(45) Date of Patent: Nov. 18, 2003

(54) MECHANISM FOR ADJUSTING TENSION OF AN INKED RIBBON OF A PRINTER

(75) Inventors: Akira Takahashi, Nagano-ken (JP); Yutaka Inokuchi, Nagano-ken (JP)

(73) Assignee: Heiwa Tokei Manufacturing Co., Ltd., Iida (JP)

( * ) Notice: Subject to any disclaimer, the term of this patent is extended or adjusted under 35 U.S.C. 154(b) by 32 days.

(21) Appl. No.: 09/843,784

(22) Filed: Apr. 30, 2001

(65) Prior Publication Data

US 2002/0012559 A1 Jan. 31, 2002

(30) Foreign Application Priority Data

Apr. 28, 2000 (JP) ..... 2000-129228
Mar. 1, 2001 (JP) ..... 2001-056383

(51) Int. Cl.[7] ..... B41J 33/14
(52) U.S. Cl. ..... 400/234; 400/236.2; 400/236
(58) Field of Search ..... 400/234, 236.2, 400/236; 347/215, 217

(56) References Cited

U.S. PATENT DOCUMENTS 4,174,078 A 11/1979 Brooks ..... 242/421.8
4,768,890 A 9/1988 Makino ..... 400/120
5,072,238 A * 12/1991 Takamiya et al. ..... 347/198
5,085,532 A * 2/1992 Surya et al. ..... 192/41 R
6,307,583 B1 * 10/2001 Randolph et al. ..... 347/217

FOREIGN PATENT DOCUMENTS

DE 19514599 A * 10/1996 ..... B41J/33/52
JP 62156980 7/1987
JP 63120677 5/1988
JP 63319174 A * 12/1988 ..... B41J/17/24
JP 06064266 A * 3/1994 ..... B41J/17/10
JP 09169147 6/1997

OTHER PUBLICATIONS

Machine translation of JP 06–064266 from the Japanese Patent Office website.*

* cited by examiner

*Primary Examiner*—Daniel J. Colilla
(74) *Attorney, Agent, or Firm*—Dennison, Schultz & Dougherty

(57) ABSTRACT

A ribbon winding side ribbon and a ribbon supply side ribbon holder are provided for supplying an inked ribbon to a thermal printer. A ribbon tension detecting plate is rotatably supported on a frame so as to be rotated in dependency on tension of the inked ribbon. A ribbon tension adjusting means is provided to be responsive to angular position of the ribbon tension detecting plate for applying a load on the ribbon holder so that the tension of the inked ribbon is adjusted.

2 Claims, 14 Drawing Sheets

MECHANISM FOR ADJUSTING TENSION OF AN INKED RIBBON OF A PRINTER

BACKGROUND OF THE INVENTION

The present invention relates to a mechanism for adjusting tension of an inked ribbon of a printer.

The thermal printer which produces printed impressions by using an inked ribbon is well known.

There are two tension applying mechanisms, one of which is provided for applying a back tension to a feeding ribbon, and the other is provided for applying a winding-up tension. The value of the tension applied to the ribbon has influence on the quality of the printing.

When the tension is too low, the ribbon wrinkles, causing printer failures in dots.

If the tension is too high, the ribbon slips and can not be fed.

Japanese Patent Application Laid Open 7-89172 discloses a mechanism for controlling tension applied to an inked ribbon to a constant value by detecting the fluctuation of the tension of the inked ribbon which is caused by the change of diameter of the rolled ribbon during the printing operation.

In the conventional system, there must be provided a sensor for detecting the ribbon tension, and tension adjusting driving mechanisms in both of the ribbon feeding side and ribbon winding-up side. Consequently, the system becomes complicated in construction.

SUMMARY OF THE INVENTION

An object of the present invention is to provide a tension adjusting mechanism which may keep the ribbon tension constant without driving mechanisms.

According to the present invention, there is provided a mechanism for adjusting tension of an inked ribbon of a printer having a pair of frames, comprising, a ribbon winding side ribbon holder rotatably supported on the frames, a ribbon supply side ribbon holder rotatably supported on the frames, guide rollers provided for guiding an inked ribbon expanded between the winding side ribbon holder and the supply side ribbon holder, at least one ribbon tension detecting plate rotatably supported on one of the frames and supporting one of the guide rollers so as to be rotated in dependency on tension of the inked ribbon, ribbon tension adjusting means responsive to angular position of the ribbon tension detecting plate for applying a load on the corresponding ribbon holder so that the tension of the inked ribbon is adjusted to a predetermined value.

The ribbon tension adjusting means comprises a brake drum provided to be rotated together with the corresponding ribbon holder, and a brake belt slidably engaged with the surface of the brake drum, a base end of the brake belt is fixed, and a movable end of the brake belt is connected to the ribbon tension detecting plate so as to be moved by the ribbon tension detecting plate in a brake belt pulling direction.

A spring is connected to the ribbon tension detecting plate so as to urge the detecting plate in the brake belt pulling direction.

The brake drum is provided to be rotated by a power source of the printer through a power cutting off device.

The power cutting off device is a differential.

In an aspect of the present invention, the power cutting off device is a friction clutch.

The differential is composed by a bevel gear device, or a planetary gear device.

These and other objects and features of the present invention will become more apparent from the following detailed description with reference to the accompanying drawings.

DETAILED DESCRIPTION OF THE PREFERRED EMBODIMENT

Figure 1:
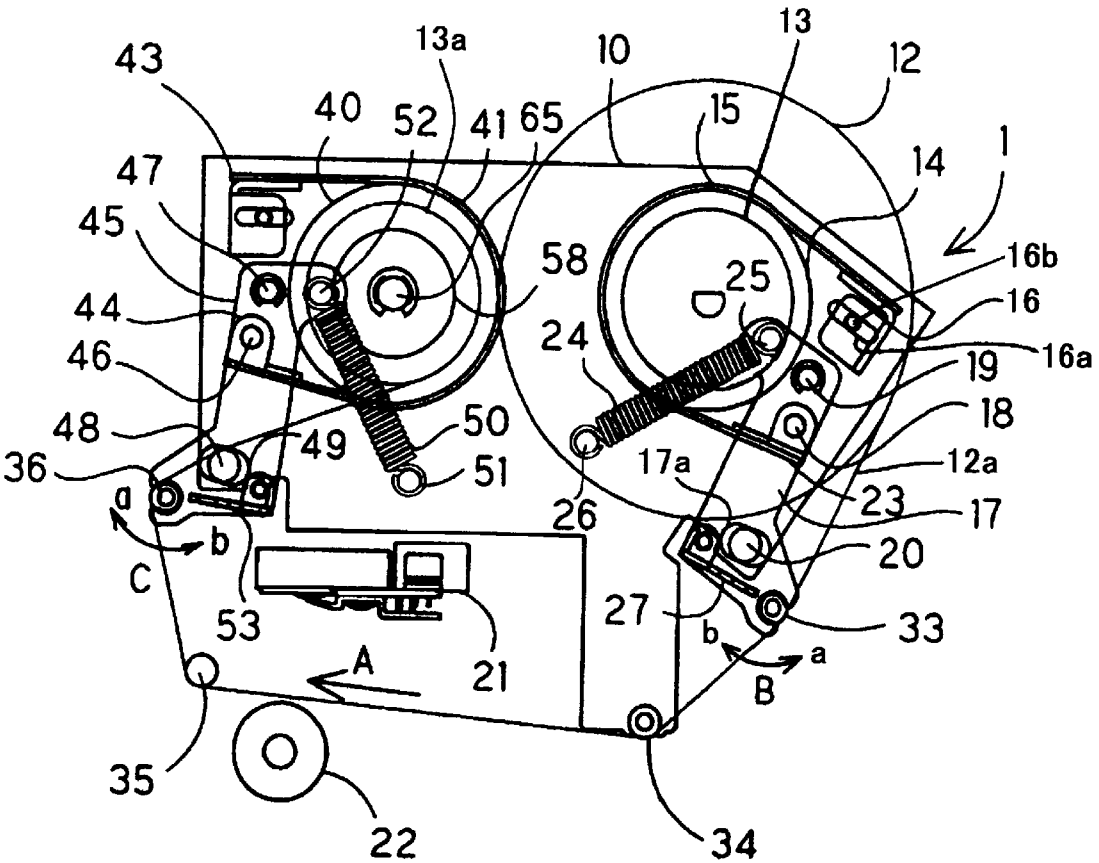
FIG. 1 is a side view of a thermal printer having a tension adjusting mechanism according to a first embodiment of the present invention.
Figure 2:
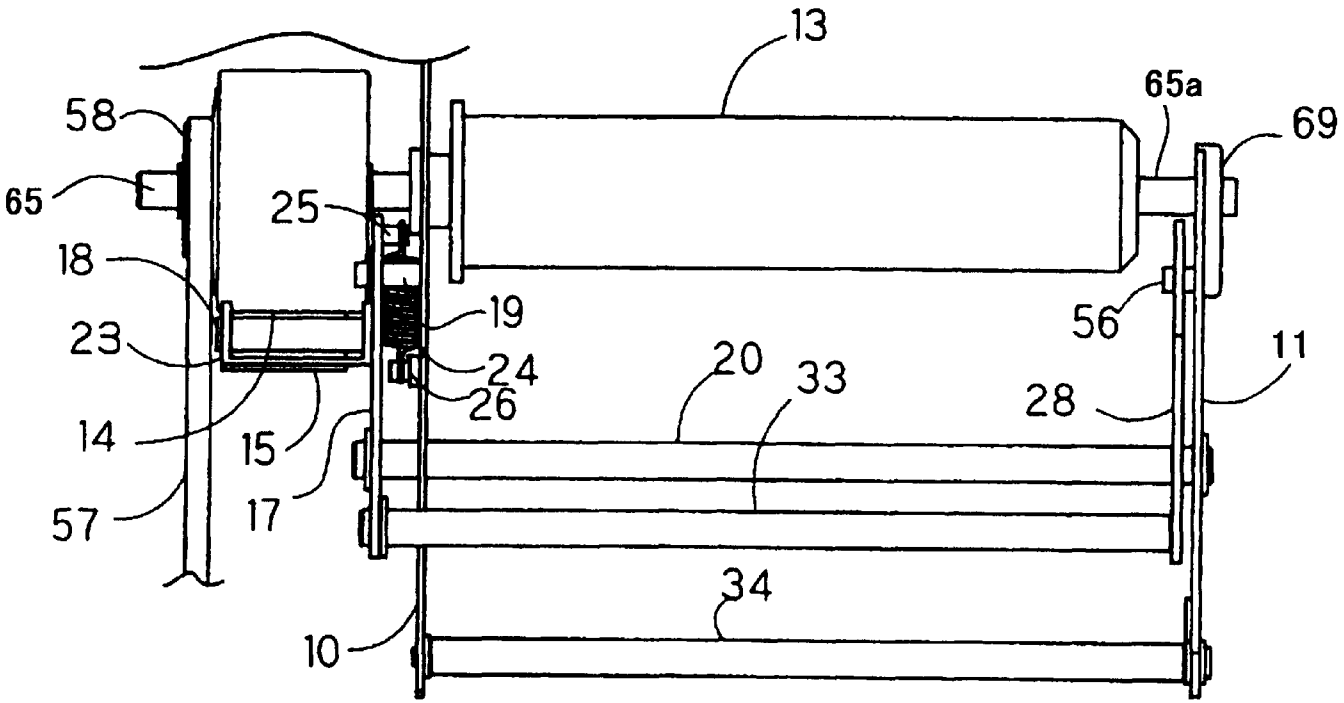
FIG. 2 is a front view of the thermal printer.

Referring to FIGS. 1 and 2, in a printing portion 1, a thermal head 21 is mounted by a thermal head supporting device (not shown) and provided to be pressed against a platen 22 to perform thermal printing. A pair of frames 10 and 11 rotatably support a ribbon supply side ribbon holder 13 and a ribbon winding side ribbon holder 13*a*. A rolled inked ribbon 12 is mounted on the ribbon holder 13. An inked ribbon 12*a* is drawn out from the rolled inked ribbon 12 in the direction of the arrow A of FIG. 1, and wound up on the ribbon holder 13*a* through ribbon guide rollers 33, 34, 35 and 36 in printing operation.

On a shaft on which the supply side ribbon holder 13 is securely mounted as will be hereinafter described, a supply side brake drum 14 is securely mounted to be rotated together with the ribbon holder 13. A brake belt 15 as a ribbon tension adjusting member and having a friction surface on which a friction material such as felt is adhered is wound on the brake drum 14 at the friction surface. An end of the brake belt 15 is secured to the frame 10 through a fixing plate 16. The fixing plate 16 is fixed to the frame 10 by a screw 16*b* inserted in an elongated hole 16*a* of the frame 10, so that the position of the fixing plate 16 can be adjusted in the longitudinal direction of the belt 15. The other end of the brake belt 15 is fixed to a fixing plate 23 which is in turn secured to a tension detecting plate 17 through a shaft 18 as shown in FIG. 2.

The tension detecting plate 17 is pivotally mounted on a shaft 19 fixed to the frame 10, and connected to a tension detecting plate 28 pivotally mounted on a shaft 56 fixed to the frame 11. The tension detecting plates 17 and 28 are connected to each other by a connecting plate 27. A shaft 20 is fixed to the frames 10 and 11 and slidably engaged in an arcuated hole 17*a* formed in each of the tension detecting plates 17 and 28 so as to limit the pivoting range of the tension detecting plates 17 and 28.

A tension spring 24 is provided between a pin 25 mounted on the tension detecting plate 17 and a pin 26 mounted on the frame 10 so as to urge the tension detecting plate 17 in the counterclockwise direction about the shaft 19 to pull the brake belt 15. The ribbon guide roller 33 is pivotally supported on the tension detecting plates 17 and 28.

On a shaft on which the ribbon winding side ribbon holder 13*a* is mounted as described hereinafter, a winding side brake drum 40 is securely mounted so as to be rotated together with the ribbon holder 13*a*. A brake belt 41 similar to the brake belt 15 is wound on the brake drum 40 at a friction surface thereof. An end of the brake belt 41 is secured to the frame 10 through a fixing plate 43 which is fixed to the frame 10 by a screw inserted in an elongated hole of the frame 10 similarly to the supply side. The other end of the brake belt 41 is fixed to a fixing plate 44 which is in turn secured to a tension detecting plate 45 through a shaft 46.

The tension detecting plate 45 is pivotally mounted on a shaft 47 secured to the frame 10, and connected to another tension detecting plate (not shown) pivotally mounted on the other side frame 11. The tension detecting plate 45 and the other tension detecting plate on the frame 11 are connected by a connecting plate 53. A shaft 48 is fixed to the frames 10 and 11 and slidably engaged in an arcuated hole 49 formed in each of tension detecting plate 45 so as to limit the pivoting range of the tension detecting plate 45.

A tension spring 50 is provided between a pin 52 mounted on the tension detecting plate 45 and a pin 51 mounted on the frame 10 so as to urge the tension detecting plate 45 in the clockwise direction about the pin 47 to pull the brake belt 41. The ribbon guide roller 36 is pivotally supported on the tension detecting plate 45.

It should be noted that the brake drum 40, tension detecting plate 45 and others in the ribbon winding side shown in FIG. 1 are positioned behind those of the ribbon supply side, and hence these members are not depicted in FIG. 2, and that the rolled ribbon 12 of FIG. 1 is omitted in FIG. 2.

Figure 3:
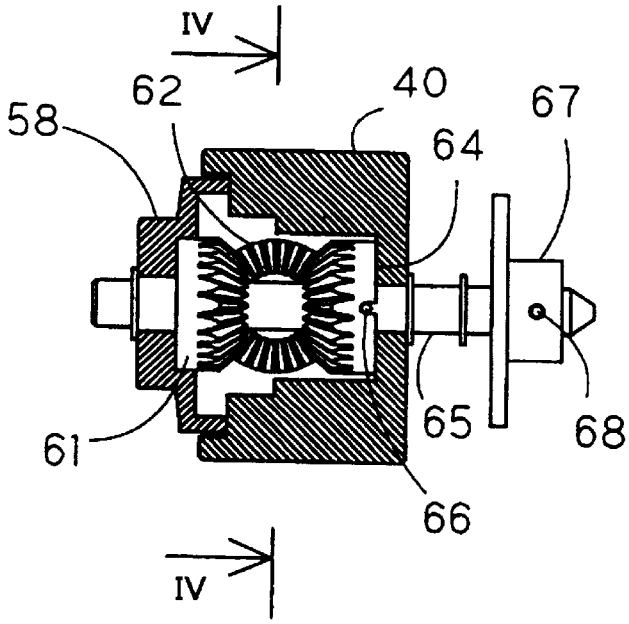
FIG. 3 is a sectional view of a brake drum having a differential transmission device.

Referring to FIGS. 2 and 3, a driving shaft 65 is rotatably supported on the frame 10 and another supporting plate (not shown) for supporting and driving the ribbon winding side ribbon holder 13*a*. The ribbon holder 13*a* is detachably supported on a supporting core 67 secured to the shaft 65 by a pin 68 and on another shaft 65*a*. The ribbon supply side ribbon holder 13 is supported in the same manner as the ribbon holder 13*a*, although supporting shafts are not shown in FIG. 2.

A pulley 58 is securely mounted on the shaft 65 and connected by a belt 57 to another pulley (not shown) which is connected to a driving source for the platen 22 through a one-way clutch (not shown) so as to transmit driving force to the pulley 58.

Figure 4:
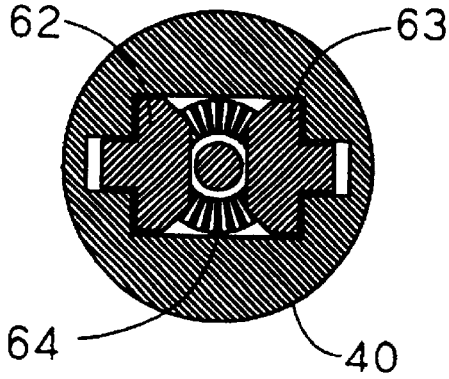
FIG. 4 is a sectional view of the brake drum taken along a line IV—IV of FIG. 3.

Referring to FIGS. 3 and 4, the winding side brake drum 40 is rotatably mounted on the shaft 65 and on a flange of the pulley 58. In the brake drum 40, a differential gear device of bevel gears is provided. The differential gear device comprises an input bevel gear 61 rotatably mounted on the shaft 65 and fixed to the pulley 58, a pair of bevel gears 62 and 63 provided in the brake drum 40, and an output bevel gear 64 fixed to the shaft 65 by a pin 66.

In operation, when the inked ribbon 12*a* is loosened in the ribbon supply side, the tension detecting plate 17 is rotated bout the shaft 19 in the direction a of the arrow B by the spring 24. Therefore, the friction surface of the brake belt 15 is pressed against the brake drum 14, so that the tension applied to the inked ribbon 12*a* increases.

When the tension of the inked ribbon 12*a* increases over the tension applied to the guide roller 33 by the tension spring 24, the tension detecting plate 17 is pivoted in the direction b of the arrow B. Consequently, the friction resistance of the brake belt 15 to the brake drum 14 reduces, thereby reducing the tension applied to the inked ribbon 12*a*.

In the ribbon winding side, when the inked ribbon 12*a* is loosened in the ribbon winding side, the tension detecting plate 45 is rotated about the shaft 47 in the direction a of the arrow C by the spring 50. Therefore, the friction surface of the brake belt 41 is pressed against the brake drum 40 to stop the brake drum 40.

Consequently, the power from the belt 57 is transmitted to the bevel gears 62 and 63 through the pulley 58 and bevel gear 61 to rotate the bevel gear 64 and the shaft 65. Thus, the ribbon holder 13*a* is rotated to wind up the ribbon 12*a*, thereby increasing the tension of the ribbon 12*a*.

When the tension of the inked ribbon 12*a* increases over the tension applied to the guide roller 36 by the tension spring 50, the tension detecting plate 45 is pivoted in the direction b of the arrow C. Consequently, the friction resistance of the brake belt 41 to the brake drum 40 reduces, thereby releasing the brake drum. Therefore, the rotation of the bevel gear 61 is transmitted to the brake drum 40 through the bevel gears 62 and 64, so that the drum 40 is rotated together with the bevel gears 62 and 64. The bevel gears 62 and 63 revolve around the bevel gear 64. Consequently, the shaft 65 does not rotate. Hence, the inked ribbon 12*a* is not wound.

Thus, the tension applied to the guide roller 36 by the tension spring 50 is balanced with the tension of the inked ribbon 12*a*, so that a constant tension can be applied to the inked ribbon in the ribbon winding side.

Figure 5:
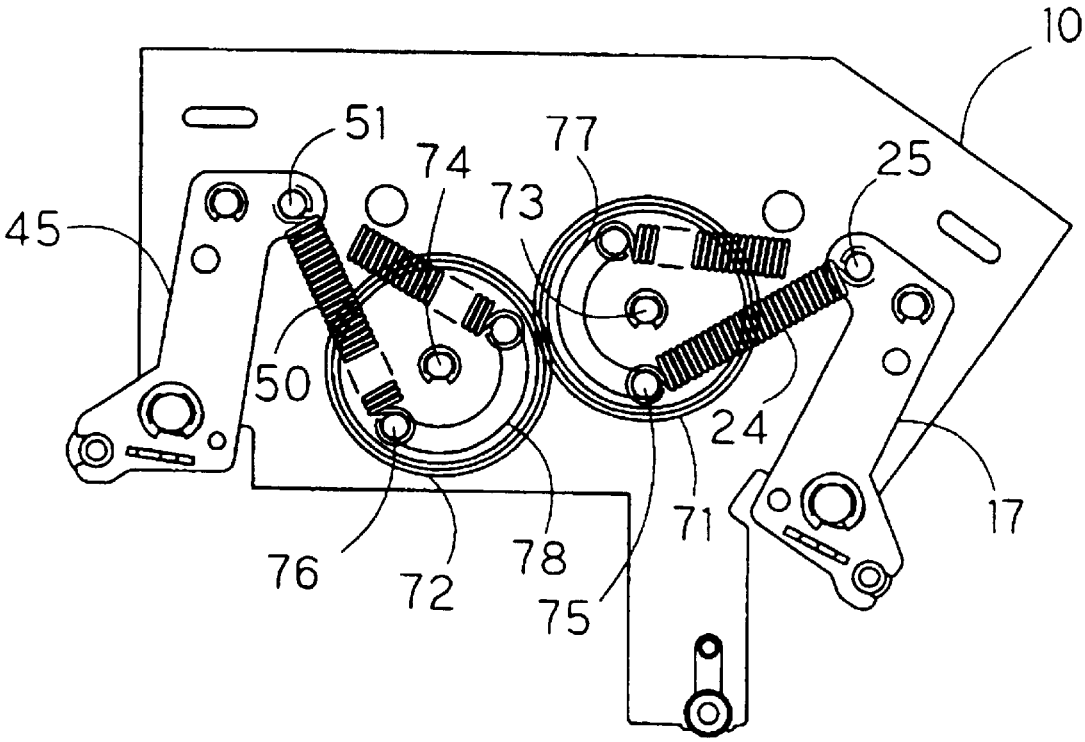
FIG. 5 is a side view of a thermal printer according to a second embodiment of the present invention.

FIG. 5 shows the second embodiment of the present invention. Two gears 71 and 72 are mounted on the frame 10 by shafts 73 and 74 and meshed with each other. Shafts 75 and 76 are fixed to the gears 71 and 72, respectively. Springs 24 and 50 are provided between shafts 75, 76 and pins 25, 51. Other ends of the shafts 75, 76 are engaged with circular holes 77 and 78, respectively.

When one of the gears 71 and 72 are rotated, the angle and length of each of the springs 24 and 50 are changed at the same time, thereby changing the tension of the ribbon. Each of the shafts 75 and 76 is secured to the adjusted position.

Figure 6A:
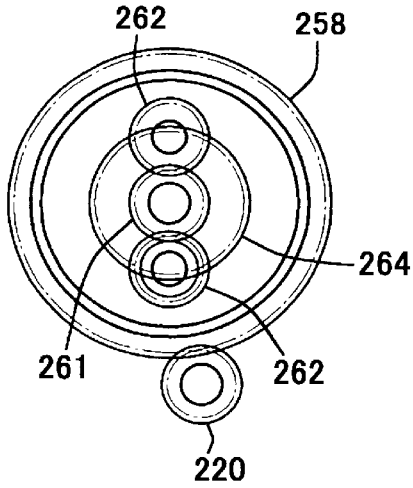
FIGS. 6*a* and 6*b* show another example of a differential composed by a planetary gear device.
Figure 6B:
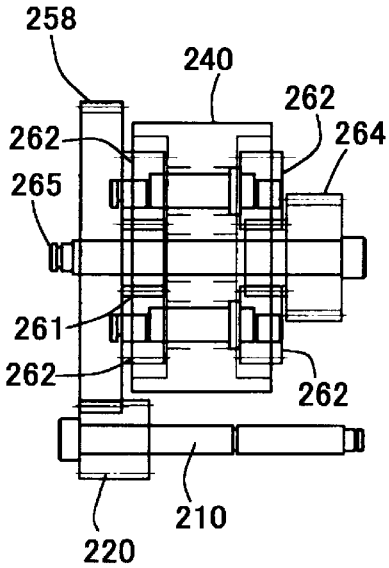

FIGS. 6*a* and 6*b* show another example of a differential composed by a planetary gear device.

The planetary gear device comprises a pair of sun gears 261 rotatably mounted on a shaft 265, two couples of planetary gears 262.

The rotation of a shaft 210 is transmitted to the input side sun gear 261 through gears 220 and 258. When a brake drum 240 is stopped, the rotation is transmitted to the gear 264 through the input side sun gear, planetary gears 262 and output side sun gear.

Figure 7:
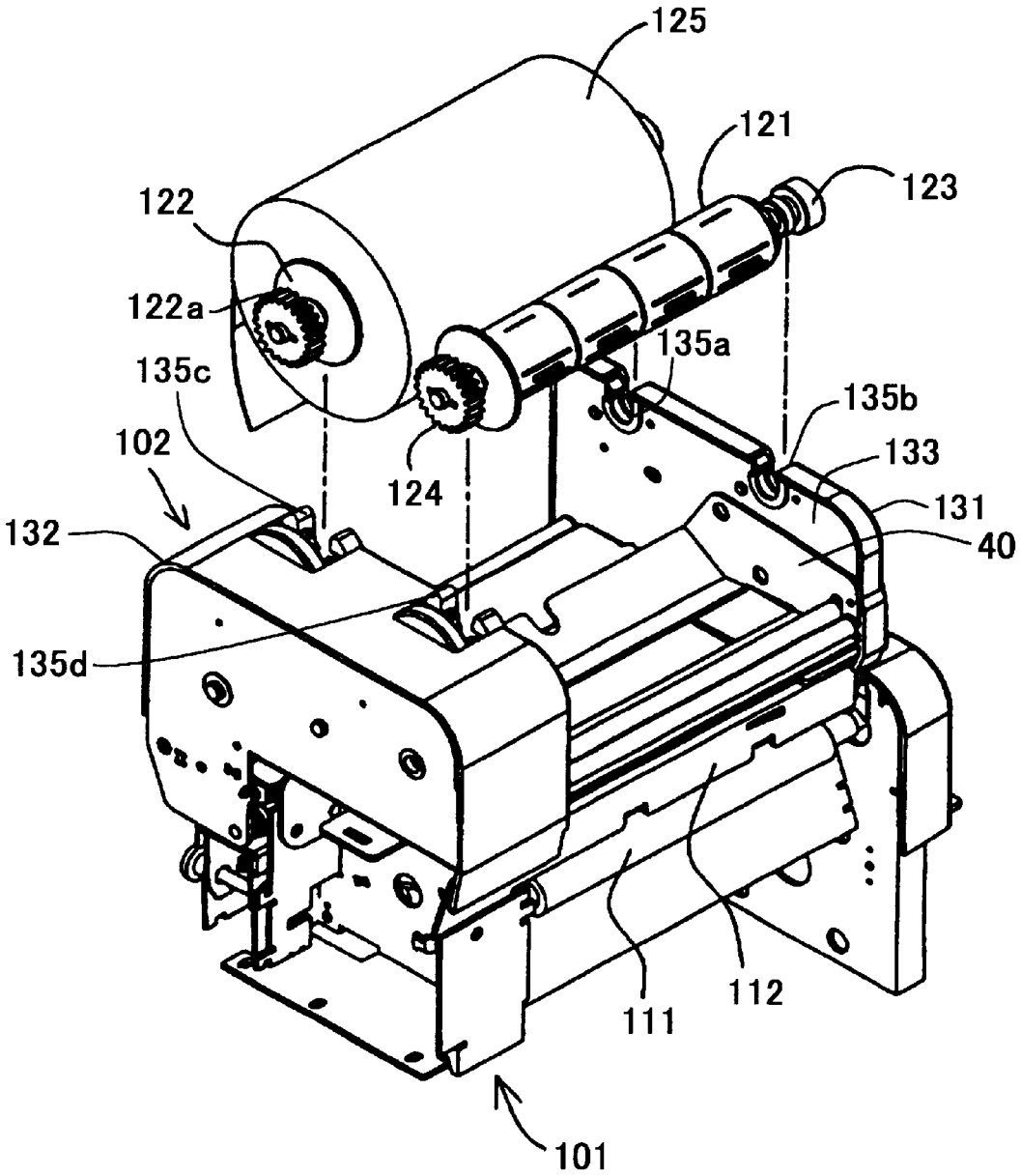
FIG. 7 is a perspective view of a thermal printer provided with a tension adjusting mechanism according to the third embodiment of the present invention.
Figure 8:
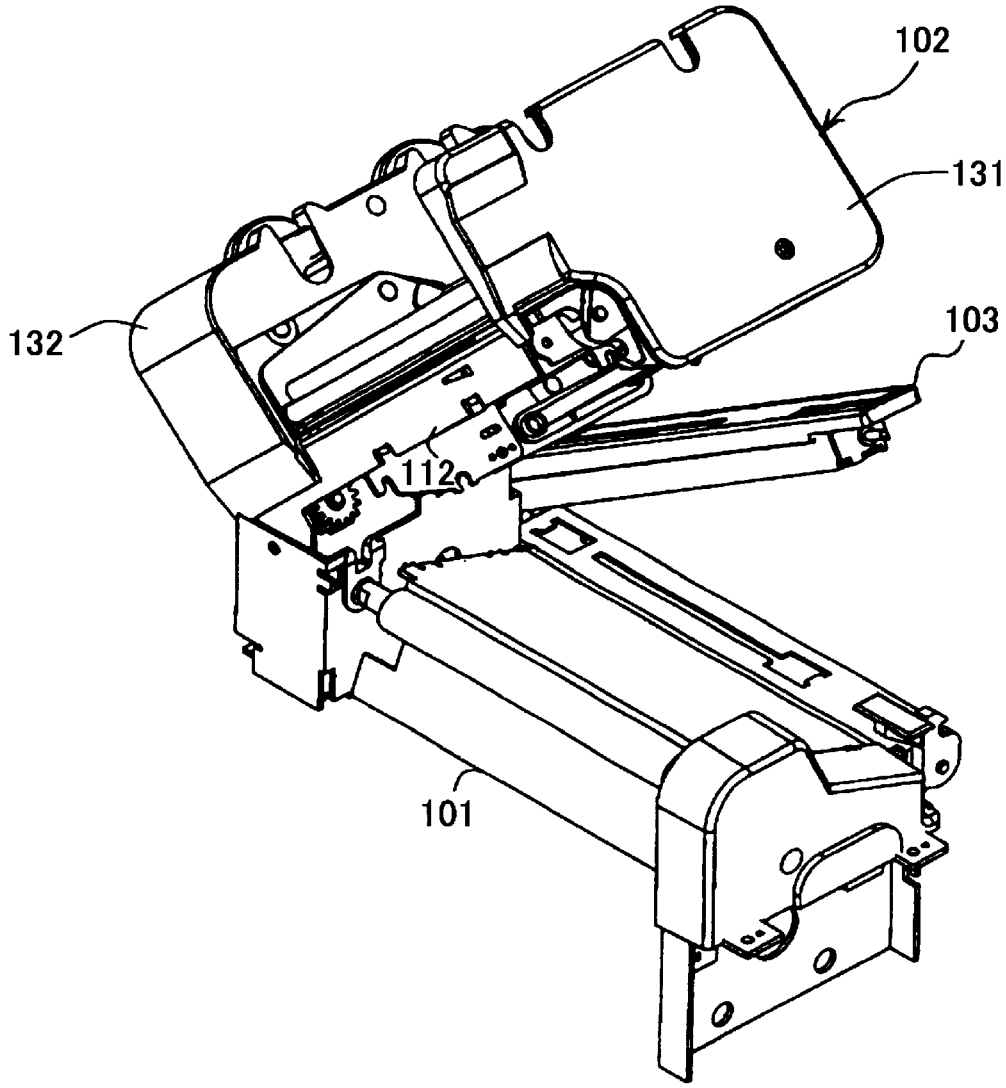
FIG. 8 is a perspective view of the thermal printer when a printing mechanism portion is opened.
Figure 9:
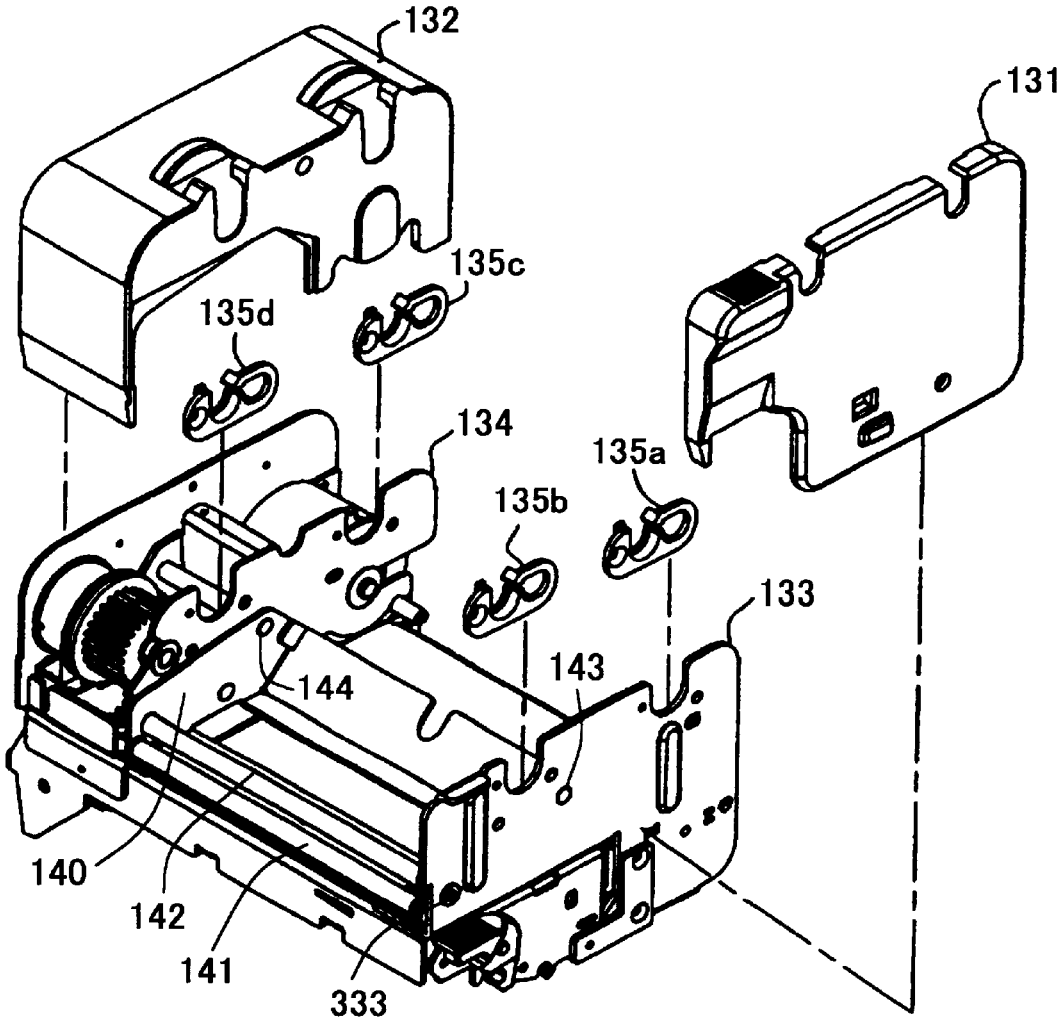
FIG. 9 is a perspective view of the thermal printer when covers are detached from frames.

FIG. 7 is a perspective view of a thermal printer provided with a tension adjusting mechanism according to the third embodiment of the present invention. FIG. 8 is a perspective view of the thermal printer when a printing mechanism portion is opened, and FIG. 9 is a perspective view of the thermal printer when covers are detached from frames.

The thermal printer 101 comprises a platen roller 111, a thermal head holder 112 holding a thermal head, a printing mechanism 102, and a paper detecting sensor 103. The printing mechanism 102 has a winding side ribbon holder 121 and a supply side ribbon holder 122, both of the holders 121 and 122 are supported on bearings 135*a* to 135*d* secured to machine frames 133 and 134 in covers 131, 132. On the supply side ribbon holder 122, a rolled inked ribbon 125 is mounted. A power transmitting gear 124 is secured to an end of a shaft of the winding side ribbon holder 121, and a knob 123 for manually rotating the holder 121 is secured to the other end of the shaft in order to tighten the ribbon on the holder.

As shown in FIG. 8, the printing mechanism 102 and the paper detecting sensor 103 can be opened in order to change the rolled ribbon and paper.

Figure 10:
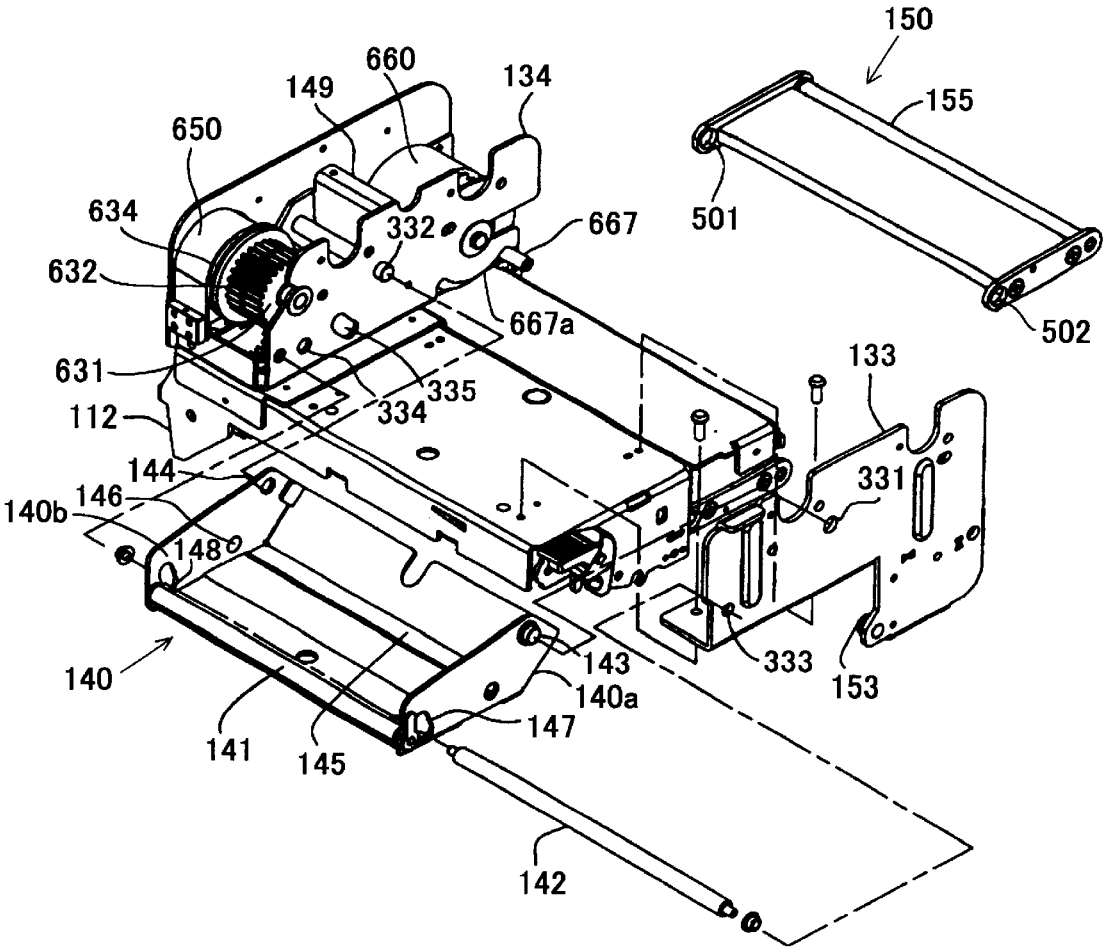
FIGS. 10 and 11 are exploded perspective views showing ribbon tension detecting means.
Figure 11:
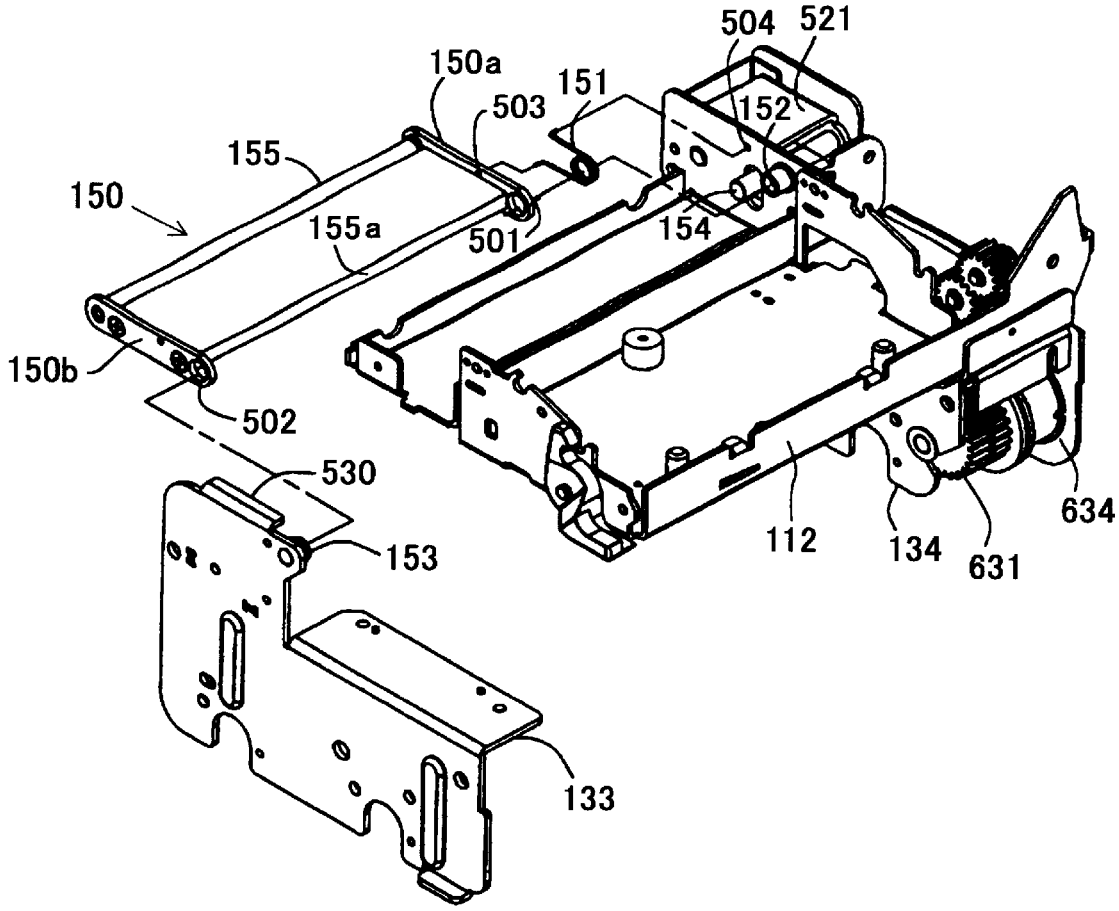

FIGS. 10 and 11 are exploded perspective views showing ribbon tension detecting means. The ribbon tension detecting means comprises a winding side ribbon tension detecting framework 140 and a supply side ribbon tension detecting framework 150. The winding side ribbon tension detecting framework 140 comprises a pair of arms 140*a* and 140*b*, a connecting plate 145 between the arms 140*a* and 140*b*, and a ribbon guide roller 141 fixed to the arms 140*a* and 140*b*.

A pin 143 of the arm 140*a* is rotatably engaged with a hole 331 of the frame 133, and a hole 144 of the arm 140*b* rotatably mounted on a shaft 332 fixed to the frame 134. Thus, the ribbon tension detecting framework 140 is pivotally supported on the frames 133 and 134. A ribbon guide roller 142 passes through elongated holes 147 and 148 of the arms 140*a* and 140*b* and is fixed to the frames 133 and 134 at holes 333 and 334.

The supply side ribbon tension detecting framework 150 comprises a pair of arms 150*a* and 150*b*, a ribbon guide roller 155 and a connecting rod 155*a* which are fixed to the arms 150*a* and 150*b*. Holes 501 and 502 formed in the arms 150*a* and 50*b* are rotatably engaged with shafts 152 and 153 securely to the frame 134 and 133, respectively. Thus, the supply side ribbon tension detecting framework 150 is pivotally mounted on the frames 133 and 134. Mounted on the shaft 152 is a coil spring 151 an end of which is engaged with a hole 503 of the arm 150*a* and the other end is engaged with a hole 504 of the frame 134, so that the ribbon tension detecting framework 150 is downwardly urged by the spring 151 so that the arm 150*a* is pressed against a shaft 154 as described hereinafter.

Figure 12A:
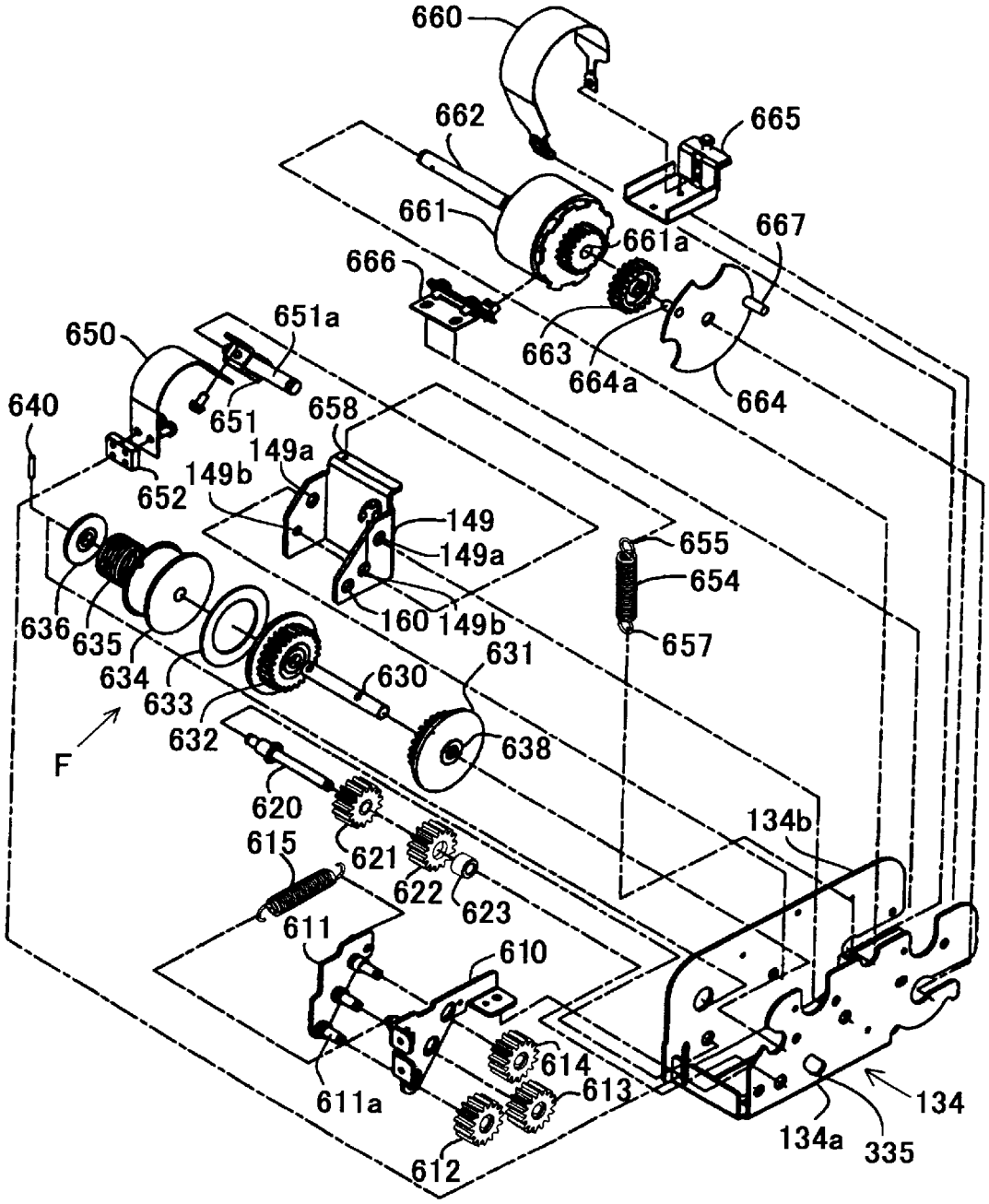
FIG. 12*a* is an exploded perspective view of a tension adjusting mechanism.

Referring to FIG. 12*a* showing a tension adjusting mechanism, a gear train comprising gears 612, 613 and 614 are rotatably mounted on a gear supporting plate 610 by a shaft plate 611 so as to transmit the power for the platen shaft to the tension adjusting mechanism. Each of the gears 612, 613 and 614 are rotatably mounted on a shaft 611*a* attached to the shaft plate 611. The shaft 611*a* is inserted in an elongated hole of the gear supporting plate 610 which is secured to the frame 134. A pulling spring 615 is provided between the gear supporting plate 610 and the shaft plate 611, thereby downwardly urging the shaft plate 611. Therefore, even if the gear 612 strikes the teeth of the gear of the platen shaft without meshing therewith, the shaft plate 611 is upwardly deflected. Consequently, the gears are prevented from breaking. Shafts 620 and 630 are rotatably supported on double walls 134*a* and 134*b* of the frame 134.

On the shaft 620, a gear 621 is securely mounted, and a reverse gear 622 is mounted, interposing a reverse one-way clutch 623.

A friction clutch F is provided on the shaft 630. The friction clutch F comprises a brake drum 634, a spring 635 inserted in the brake drum 634, a pressure plate 636 fixed to the shaft 630 to press the spring 635 axially into the brake drum 634, a friction plate 633 rotatably mounted on the shaft 630, and a free gear 632 rotatably mounted on the shaft 630. The brake drum 634 is attached to the shaft 630 by a pin 640 the end of which is slidably engaged with an axial groove formed on the shaft 630 so that the drum 634 can be rotated together with the shaft and axially urged by the spring 635. Thus, the drum 634 pushes the friction plate 633 so that the friction plate is pressed against the side of the gear 632. A gear 631 is mounted on the shaft 630 through a one-way clutch 638 which transmits rotating power to the gear 631 only in the ribbon winding rotating direction of the shaft 630. The gear 631 meshes with the gear 124 (FIG. 7) of the ribbon holder 121.

The gear 632 engages with the gear 621 secured on the shaft 620, and the gear 631 engages with the reverse gear 622 mounted on the shaft 620 through the reverse one-way clutch 623. Therefore, the power for driving the platen roller 111 is transmitted to the gear 632 through the gear 621 and to the shaft 630 through the brake drum 634 interposing the friction plate 633 there-between. The rotation of the shaft 630 causes the gear 631 to rotate through the one-way clutch 638 to rotate the ribbon holder 121, thereby winding the ribbon.

Figure 13:
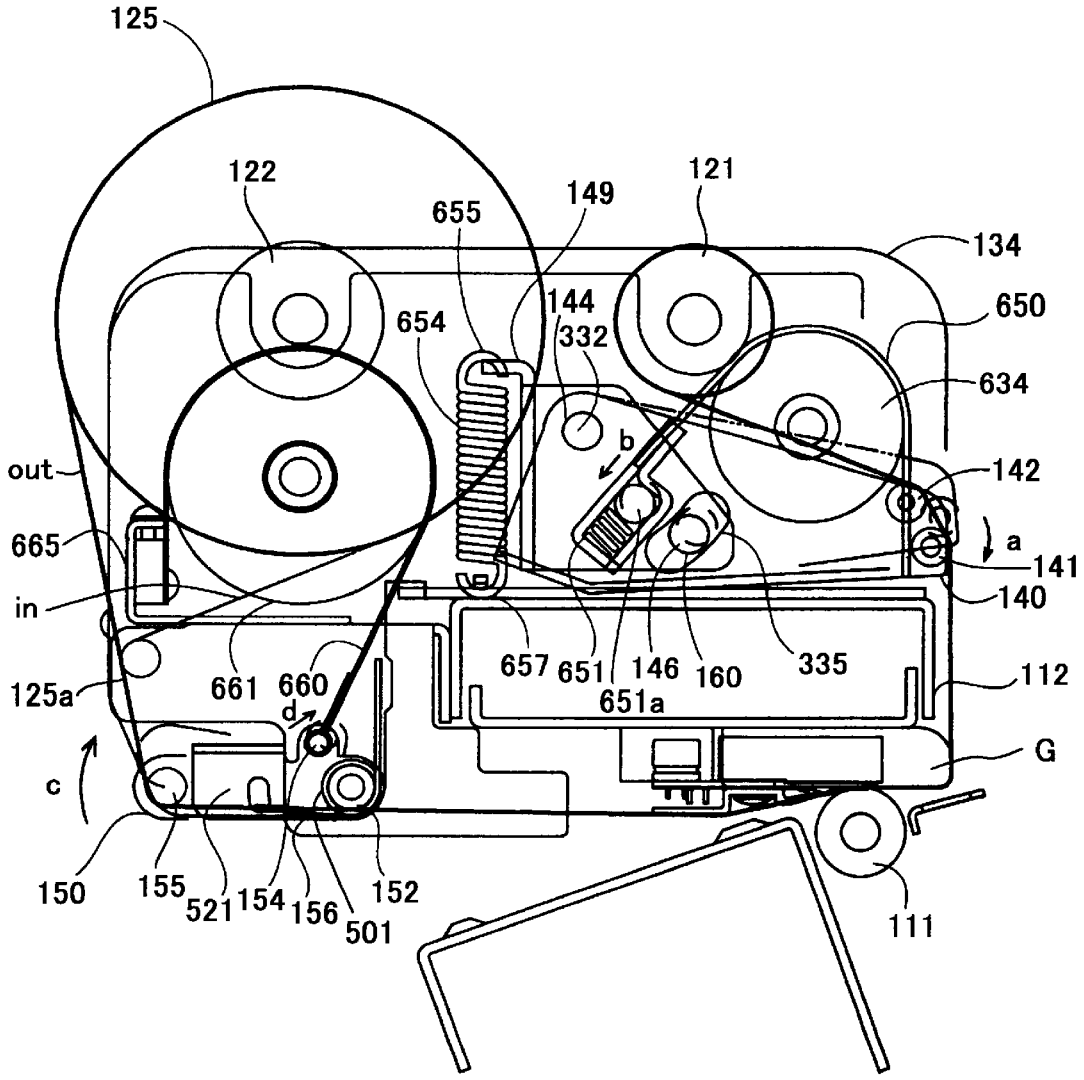
FIG. 13 is a side view of the thermal printer.

A brake belt 650 made of friction material such as felt is contacted with the brake drum 634 in order to apply friction to the drum. One of ends of the brake belt 650 is connected to the frame 134 through a fixing plate 652, and the other end of the belt is connected to a movable plate 651 slidably mounted on a shaft 651*a*. The shaft 651*a* is connected to a belt tension plate 149 at holes 149*b* thereof. The belt tension plate 149 is rotatably mounted on the shaft 332 at holes 149*a*. The shaft 332 supports the arms 140*a* and 140*b* of the ribbon tension detecting framework 140 as described above. The ribbon tension detecting framework 140 and the belt tension plate 149 are connected with each other by a pin 146 fixed to the arm 140*b* and engaged with a hole 160 of the plate 149 as shown in FIG. 13. An end of the pin 146 is slidably engaged with an elongated hole 335 of the frame 134 (FIG. 7). Thus, the belt tension plate 149 is rotated by the ribbon tension detecting framework 140.

Referring to FIGS. 12*a* and 13, a hook 655 of a tension spring 654 is hung on a hook 658 of the belt tension plate 149, and another hook 657 is connected to the frame 134 to urge the ribbon tension detecting framework 140 and the belt tension plate 149 in the counterclockwise direction about the shaft 332.

Referring to FIG. 13, the ribbon 125*a* from the rolled ribbon 125 passes through the guide roller 155, a guide corner G and the guide rollers 141 and 142 and is wound on the ribbon holder 121.

When the tension of the ribbon 125*a* increases, the ribbon tension detecting framework 140 and the belt tension plate 149 connected to the framework 140 by the pin 146 are rotated in the clockwise direction a about the shaft 332. The rotation of the plate 149 causes the shaft 651*a* fixed to the plate and the belt plate 651 engaged with the shaft 651*a* to move in the direction b of FIG. 13. Consequently, the belt 650 connected to the belt plate 651 is pulled in the direction b, so that the tension of the belt 650 increases to increase the friction between the belt and the brake drum 634. Thus, the brake drum 634 is braked to reduce the winding tension of the ribbon 125*a*.

Therefore, when the tension of the ribbon becomes higher than a predetermined value, the brake belt 650 is pulled to increase the friction between the belt and the brake drum 634 increases to reduce the power to the ribbon holder 121. When the ribbon tension becomes the predetermined value, the brake belt 650 loosens to increase the power to the ribbon holder 121. Thus, the tension of the inked ribbon is kept constant.

When the platen roller 111 is reversely rotated for the back feed, the gear 631 is reversely rotated through the reverse one-way clutch 623, so that the inked ribbon on the ribbon holder 121 is pulled out. For the back feed operation, a back feed tension control device is provided for the shaft 620, so that the ribbon tension is also controlled in the back feed operation.

Figure 14:
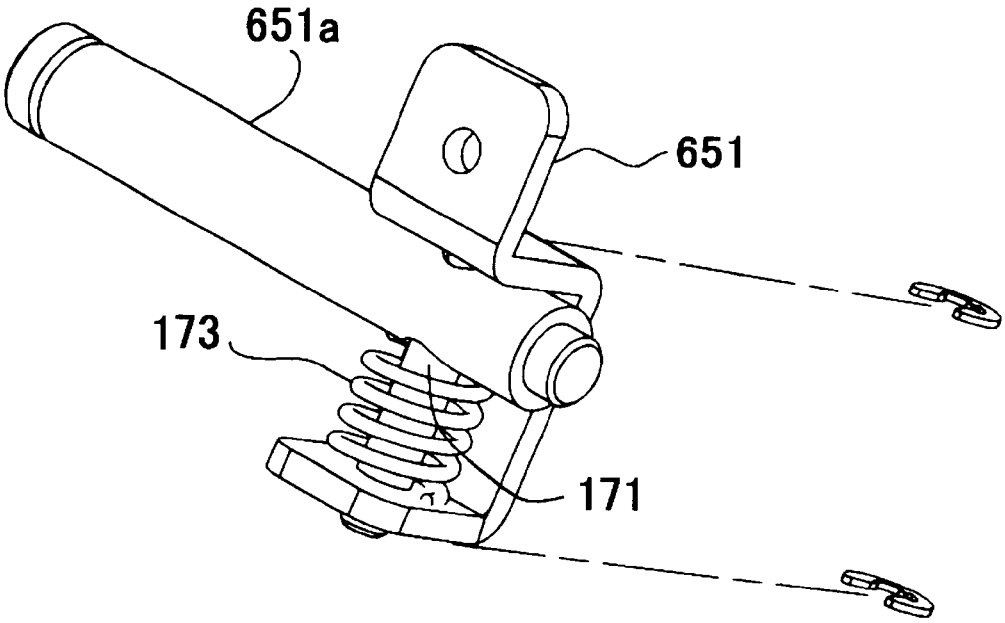
FIG. 14 shows details of a movable plate.

FIG. 14 shows details of the movable plate 651. A spring 173 is mounted on a shaft 171 which penetrates the shaft 651*a* and is fixed to the movable plate 651 by a pair of E-rings.

When the belt 650 is pulled hard, the plate 651 upwardly moves. Therefore, the belt is prevented from breaking.

A tension adjust mechanism for the ribbon supply side will be described hereinafter with reference to FIGS. 11 to 13.

Figure 12B:
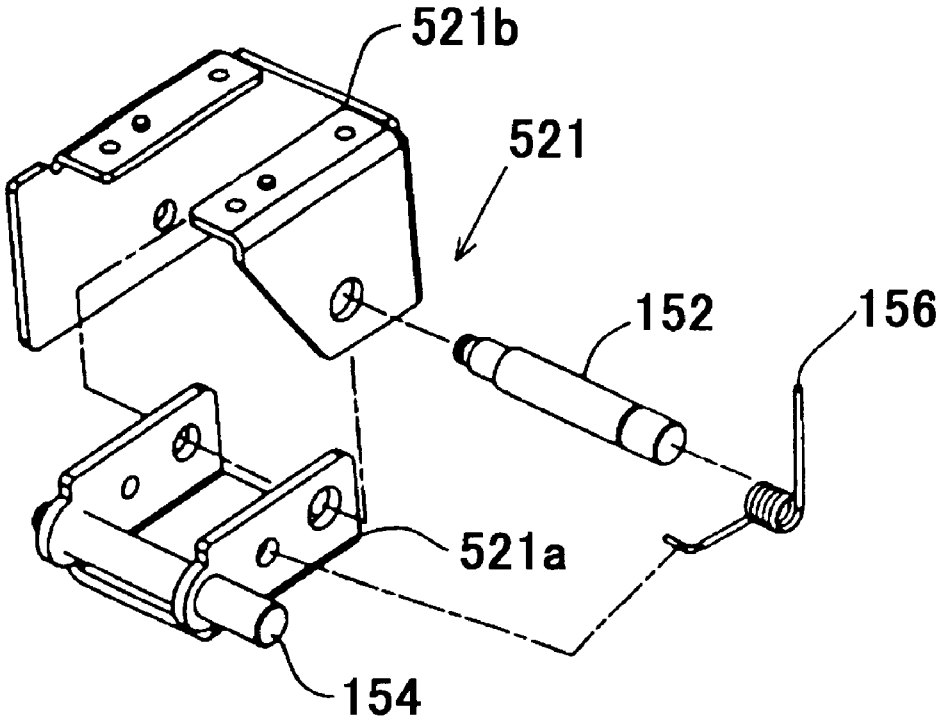
FIG. 12*b* is an exploded perspective view of a belt tension plate.

A belt tension plate 521 is rotatably supported on the frame 134 by a shaft 152 (FIGS. 11 and 12*b*). Referring to FIG. 12*b*, the belt tension plate 521 comprises an outside frame 521*b* and an inside frame 521*a* and is urged in the counterclockwise direction by a spring 156. The shaft 154 with which the arm 150*a* of the ribbon tension detecting framework 150 is contacted as described above is securely mounted on the belt tension plate 521.

A ribbon supply side brake drum 661 has a shaft 662 secured thereto and is rotatably supported on the frame 134 by the shaft 662. A brake belt 660 is mounted on the brake drum 661. An end of the brake belt 660 is fixed to a plate 665 secured to the frame 134 and the other end is engaged with the shaft 154.

The belt tension plate 521 is urged by a spring in the counterclockwise direction in FIG. 13, thereby applying tension to the brake belt 660. A ribbon end detecting sensor 666 is mounted on the frame 134 so as to detect the end of the inked ribbon 125*a*.

A gear 661*a* fixed to the shaft 662 of the brake drum 661 is engaged with a gear 663 mounted on a shaft 664*a* of a rotating plate 664. The gear 663 engages with a gear 122*a* (FIG. 7) of the ribbon holder 122 so that the rotation of the holder is transmitted to the brake drum 661.

A lever 667 mounted on the rotating plate 664 is slidably contacted with a semicircular guide groove 667*a* as shown in FIG. 10, so that the lever and hence the rotating plate 664 can be rotated about 90 degrees to change the position of the gear 663.

There is provided an outside winding rolled ribbon and an inside winding rolled ribbon for the thermal printer. In FIG. 13, "out" indicates the outside wound ribbon, and "in" indicates the inside wound ribbon. If the kind of the rolled ribbon is changed, the transmitting direction of the rotary force changes. By changing the position of the gear 663 by the lever 667, the gear 122*a* of the holder 122 is prevented from disengaging from the gear 663.

As described hereinbefore, the ribbon tension detecting framework 150 is upwardly urged by the spring 151 to be contacted with the shaft 154.

When the tension of the ribbon 125*a* increases, the ribbon tension detecting framework 150 and the belt tension plate 521 connected to the framework 150 are rotated in the clockwise direction c (FIG. 13) about the shafts 152 and 153. The rotation of the plate 521 causes the shaft 154 to move in the direction d of FIG. 13. Consequently the belt 660 is loosened, so that the load on the brake drum 661 is reduced to reduce the winding tension of the ribbon 125*a*.

In accordance with the present invention, tension of the inked ribbon is kept constant even if the diameter of the rolled ribbon changes.

While the invention has been described in conjunction with preferred specific embodiment thereof, it will be understood that this description is intended to illustrate and not limit the scope of the invention, which is defined by the following claims.

What is claimed is:

1. A mechanism for adjusting tension of an inked ribbon of a printer having a pair of frames, comprising:

a ribbon winding side ribbon holder rotatably supported on the frames;

a ribbon supply side ribbon holder rotatably supported on the frames;

guide rollers provided for guiding an inked ribbon expanded between the winding side ribbon holder and the supply side ribbon holder;

at least one ribbon tension detecting plate rotatably supported on one of the frames and supporting one of the guide rollers so as to be rotated in dependency on tension of the inked ribbon;

ribbon tension adjusting means comprising a brake drum provided to be rotated together with a corresponding ribbon holder, and a brake belt slidably engaged with the surface of the brake drum, a base end of the brake belt is fixed, and a movable end of the brake belt is connected to the ribbon tension detecting plate so as to be moved by the ribbon tension detecting plate in a brake belt pulling direction;

a spring connected to the ribbon tension detecting plate so as to urge the detecting plate in the brake belt pulling direction;

wherein the brake drum is provided to be rotated by a power source of the printer through a differential composed by a bevel gear device.

2. The mechanism according to claim 1 wherein the differential is composed by a planetary gear device.

* * * * *